US006724362B2

(12) United States Patent
Min

(10) Patent No.: US 6,724,362 B2
(45) **Date of Patent: *Apr. 20, 2004**

(54) THIN FILM TRANSISTOR-LIQUID CRYSTAL DISPLAY DRIVER

(75) Inventor: Byung Moo Min, Kyonggi-do (KR)

(73) Assignee: Hyundai Electronics Industries Co., Ltd., Kyoungki-do (KR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 198 days.

(21) Appl. No.: 09/484,054

(22) Filed: Jan. 18, 2000

(65) Prior Publication Data

US 2002/0171616 A1 Nov. 21, 2002

(30) Foreign Application Priority Data

Jan. 19, 1999 (KR) ..... 1999-1520

(51) Int. Cl.[7] ..... G09G 3/36
(52) U.S. Cl. ..... 345/100; 345/92
(58) Field of Search ..... 345/96, 100, 94, 345/99, 92, 98, 209, 87, 152, 208, 210, 213

(56) References Cited

U.S. PATENT DOCUMENTS 5,122,790 A * 6/1992 Yasuda et al. ..... 340/784
5,790,092 A * 8/1998 Moriyama ..... 345/96
5,886,679 A * 3/1999 Matsuda et al. ..... 345/96
6,075,505 A * 6/2000 Shiba et al. ..... 345/205
6,172,662 B1 * 1/2001 Ito et al. ..... 345/94
6,249,842 B1 * 6/2001 Buch ..... 710/52
6,271,783 B1 * 8/2001 Cairns et al. ..... 341/144
6,335,719 B1 * 1/2002 An et al. ..... 345/96
6,342,876 B1 * 1/2002 Kim ..... 345/213
6,400,350 B1 * 6/2002 Nishimura et al. ..... 345/209

* cited by examiner

*Primary Examiner*—Vijay Shankar
*Assistant Examiner*—Nitin Patel
(74) *Attorney, Agent, or Firm*—Morgan, Lewis & Bockius LLP

(57) ABSTRACT

A TFT-LCD driver includes a TFT-LCD panel having a plurality of gate bus lines, a plurality of source bus lines, a plurality of TFT's, and a plurality of liquid crystal cells corresponding to the plurality of TFT's, a gate driver integrated circuit for supplying driving voltages to the gate bus lines to turn the TFT's on and off, a source driver integrated circuit for sequentially supplying analog voltages to the source bus lines so as to input the analog voltages to the plurality of liquid crystal cells through the turned-on TFT's, and a controller for providing control signals to the gate driver integrated circuit and the source driver integrated circuit, wherein the analog voltages supplied from the source driver integrated circuit to the TFT-LCD panel have the same polarity at least twice in sequence, wherein the source driver integrated circuit drives the TFT-LCD panel using one of a dot inversion method and a pixel inversion method.

4 Claims, 3 Drawing Sheets

FIG.5

| | INPUT SEQUENCE TO DATA REGISTER | OUTPUT SEQUENCE FROM DATA REGISTER | |
|---|---|---|---|
| FIRST SUB-FIELD | (+)FIRST DATA<br>(−)SECOND DATA<br>(+)THIRD DATA<br>(−)FOURTH DATA | (+)FIRST DATA<br>(+)THIRD DATA<br>(−)SECOND DATA<br>(−)FOURTH DATA | FIRST SUB-FIELD |
| SECOND SUB-FIELD | (+)FIRST DATA<br>(−)SECOND DATA<br>(+)THIRD DATA<br>(−)FOURTH DATA | (+)FIRST DATA<br>(+)THIRD DATA | SECOND SUB-FIELD |
| | ⋮ | ⋮ | |

THIN FILM TRANSISTOR-LIQUID CRYSTAL DISPLAY DRIVER

This application claims the benefit of Korean patent application No. 1520/1999, filed Jan. 19, 1999, which is hereby incorporated by reference.

BACKGROUND OF THE INVENTION

1. Field of the Invention

The present invention relates to a TFT-LCD (Thin Film Transistor Liquid Crystal Display) driver, and more particularly, to a TFT-LCD driver that consumes less power.

2. Background of the Related Art

FIG. 1 is a block diagram of a related art TFT-LCD driver, and FIG. 2 is a block diagram of a controller for the related art TFT-LCD driver.

Referring to FIG. 1, a related art TFT-LCD includes a TFT-LCD panel 11 having a plurality of gate bus lines and source bus lines, with TFT's (switching devices) formed thereon. Capacitors are formed by injection of a liquid crystal material into a space between an upper plate and a lower plate of the TFT-LCD panel 11, to form an array of liquid crystal cells. A gate driver IC (Integrated Circuit) 12 is on a left side of the TFT-LCD panel 11 and supplies driving voltages to the gate bus lines in succession to turn the TFT's on and off. A source driver IC 13 is on an upper side of the TFT-LCD panel 11 and sequentially supplies video signal voltages to the source bus lines in the TFT-LCD panel 11, to apply data voltages to each liquid crystal cell, with the data voltages passing through the turned-on TFT's. A controller 14 provides control signals required for the gate driver IC 12 and the source driver IC 13.

As shown in FIG. 2, the controller 14 includes column/row control programming units 21 and 22 for receiving external data, and a pixel logic/timing generator 23 with a data buffer for converting outputs from the column/row control programming units 21 and 22 into control signals required for the gate driver IC 12 and the source driver IC 13

The operation of the related art TFT-LCD driver will be explained below.

The controller 14 generates sequential control signals for providing row addresses for received external data, provides the control signals to the gate driver IC 12, and provides digital R, G, B (Red, Green and Blue) data for row addresses to the source driver IC 13 The gate driver IC 12 supplies sequential driving voltages to the gate bus lines in the TFT-LCD panel 11, to sequentially turn on the TFT's for the row addresses. Then, the source driver IC 13 receives the digital R, G, B data from the controller 14, converts the digital R, G, B, data into analog voltages, and supplies the analog voltages to the source bus lines in the TFT-LCD panel 11. The analog voltages are stored in capacitors in a liquid crystal cell array in the TFT-LCD panel 11 after passing through the TFT's, which are turned on by the gate driver IC 12. As shown in FIG. 1, voltages stored in each liquid crystal cell in the TFT-LCD panel 11 are charged as either (+) or (−) in an alternate manner. The (+) voltage is $V_{DD}$-$V_{COM}$, the (−) voltage is $V_{COM}$-$V_{ss}$, and $V_{COM}$ is approximately ½($V_{DD}$+VSS).

However, the related art TFT-LCD driver has high power consumption due to the TFT-LCD panel and the source driver IC, because capacitors on data lines in a column direction are charged every time a row is addressed, as the liquid crystal cells in the TFT-LCD panel are alternately charged to (+) or (−) for every frame in sequential row addressing.

SUMMARY OF THE INVENTION

Accordingly, the present invention is directed to TFT-LCD driver that substantially obviates one or more of the problems due to limitations and disadvantages of the related art An object of the present invention is to provide a TFT-LCD driver which consumes less power when driving a source driver IC and the TFT-LCD.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, in one aspect of the present invention there is provided a TFT-LCD driver including a TFT-LCD panel having a plurality of gate bus lines, a plurality of source bus lines, a plurality of TFT's, and a plurality of liquid crystal cells corresponding to the plurality of TFT's, a gate driver integrated circuit for supplying driving voltages to the gate bus lines to turn the TFT's on and off, a source driver integrated circuit for sequentially supplying analog voltages to the source bus lines so as to input analog voltages to the plurality of liquid crystal cells through the turned-on TFT'S, and a controller for providing control signals to the gate driver integrated circuit and the source driver integrated circuit, wherein the analog voltages supplied from the source driver integrated circuit to the TFT-LCD panel have the same polarity at least twice in sequence, wherein the source driver integrated circuit drives the TFT-LCD panel using one of a dot inversion method and a pixel inversion method.

In another aspect of the present invention there is provided a liquid crystal display including an upper plate, a lower plate facing the upper plate, a plurality of gate bus lines and a plurality of source bus lines on the lower plate, thin film transistors formed at intersections of the gate bus lines and the source bus lines, a liquid crystal cell capacitor array formed at locations corresponding to the thin film transistors between the upper plate and the lower plate, a gate driver circuit for turning the thin film transistors on and off, a source driver circuit for supplying analog voltages to the source bus lines, wherein the analog voltages are stored in the liquid crystal cell capacitor array through the thin film transistors, and a controller for providing control signals to the gate driver circuit and the source driver circuit, wherein analog voltages outputted from the source driver circuit have the same polarity at least twice in a row, and wherein the source driver circuit drives the liquid crystal display using one of a dot inversion method and a pixel inversion method.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 5 is a table showing sequences of storing and outputting data to/from a controller in the TFT-LCD driver of the present invention.

DETAILED DESCRIPTION OF THE PREFERRED EMBODIMENT

Reference will now be made in detail to the preferred embodiments of the present invention, examples of which are illustrated in the accompanying drawings.

Figure 1:
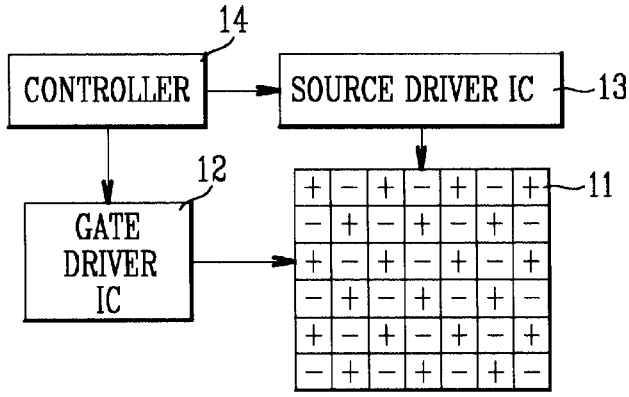
FIG.1 Related Art
FIG. 1 is a block diagram of a related art TFT-LCD driver.
Figure 2:
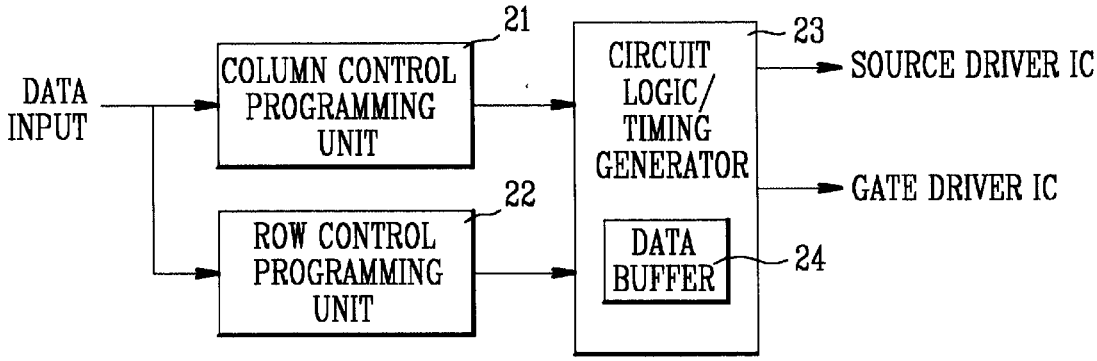
FIG.2 Related Art
FIG. 2 is a block diagram of a controller of the related art TFT-LCD driver.
Figure 3:
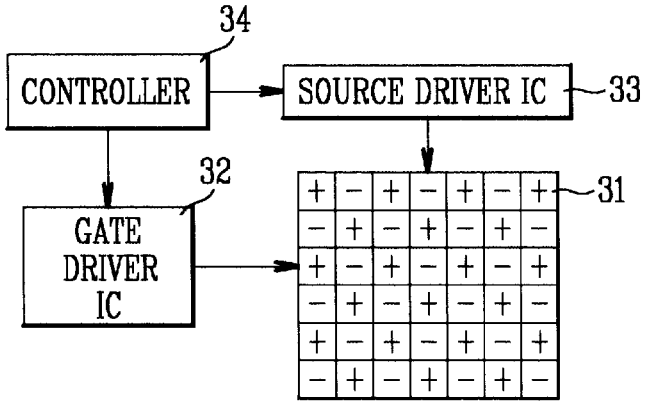
FIG. 3 is a block diagram of a TFT-LCD driver in accordance with a preferred embodiment of the present invention.

Referring to FIG. 3, a TFT-LCD driver in accordance with a preferred embodiment of the present invention is used with a TFT-LCD panel 31 having a plurality of gate bus lines, source bus lines, and TFT's. Capacitor cells are formed by injection of a liquid crystal into a space between an upper plate and a lower plate of the TFT-LCD panel 31. A gate driver IC (Integrated Circuit) 32 is on a left side of the TFT-LCD panel 31 and sequentially supplies driving voltages to the gate bus lines in the TFT-LCD panel 31 to turn the TFT's on and off. A source driver IC 33 is on an upper side of the TFT-LCD panel 31 and sequentially supplies video signal voltages to the source bus lines in the TFT-LCD panel 31, so that data voltages can be applied to liquid crystal cells through the turned-on TFT's. A controller 34 provides control signals required for the gate driver IC 32 and the source driver IC 33, so that analog data supplied from the source driver IC 33 to the TFT-LCD panel 31 has the same polarities at least twice in sequence. The source driver IC 33 drives the TFT-LCD panel 31 using a dot inversion method or a pixel inversion method.

Figure 4:
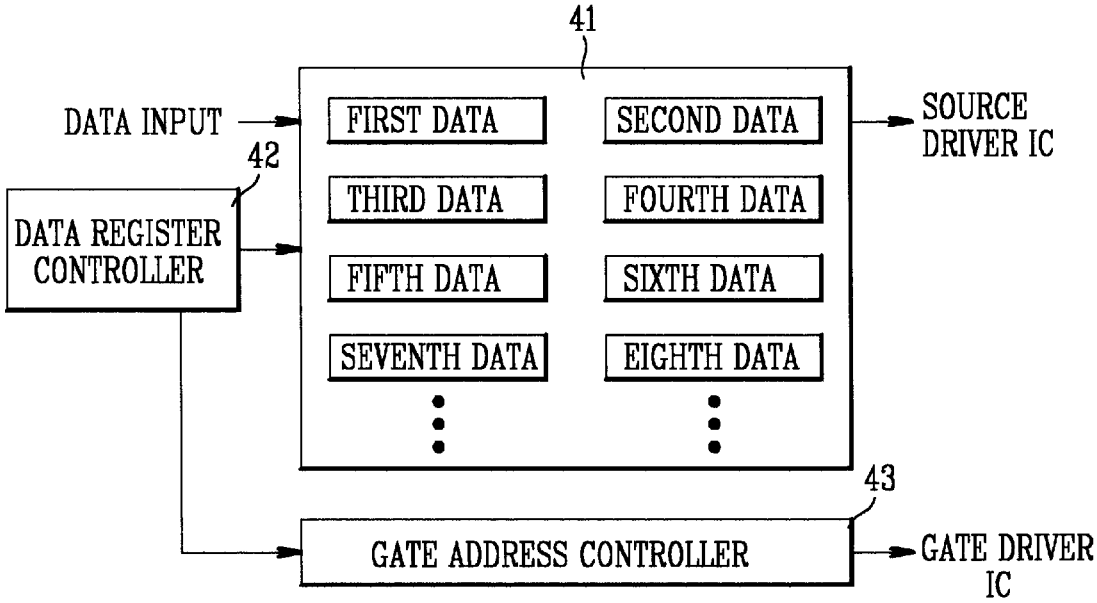
FIG. 4 is a block diagram of a controller of the TFT-LCD driver of the preferred embodiment of the present invention.

As shown in FIG. 4, the controller 34 includes a data register 41 for temporarily receiving and storing external data, a data register controller 42 for providing a control signal to the data register 41 to control a sequence of outputting data from the data register 41 to the source driver IC 33, and a gate address controller 43 for receiving the control signals from the data register controller 42 to control the gate driver IC 32. The data outputted to the source driver IC 33 and the signal to the gate driver IC 32 are synchronized.

The operation of the TFT-LCD driver in accordance with the preferred embodiment will now be explained.

When the controller 34 receives external data, the data register 41 sequentially stores the external data. Then, the data register controller 42 controls the data register 41 so that, of the data stored in the data register 41, analog data supplied from the source driver IC 33 to the TFT-LCD panel 31 have the same polarities two or more than two times in sequence, i.e., odd numbered address data are provided twice to the source driver IC 33 before even numbered address data are provided to the source driver IC 33. The source driver IC 33 drives the TFT-LCD panel 31 using a dot or a pixel inversion method. At the same time, the data register controller 42 controls the gate address controller 43 such that data from the data register 41 supplied to the source driver IC 33 and the signal from the gate driver IC 32 are synchronized.

Then, upon receiving an output from the gate address controller 43, the gate driver IC 32 sequentially supplies driving voltages to the gate bus lines in the TFT-LCD panel 31, to turn on the TFT's for odd numbered address data before turning on the TFT's for even numbered address data. Also, upon reception of odd numbered outputs from the data register 41, the source driver IC 33 converts odd numbered digital R, G, B address data into analog voltages and provides the analog voltages to the source bus lines in the TFT-LCD panel 31. Then, the source driver IC 33 receives even numbered outputs from the data register 41, converts even numbered digital R, G, B data into analog voltages, supplies the analog voltages to the source bus lines in the TFT-LCD panel 31, and stores the analog voltages in capacitors in the liquid crystal cell array in the TFT-LCD panel 31 by passing them through the TFT's that are turned on by the gate driver IC 32.

The sequence of even or odd numbered outputs may also be reversed.

The operation of the TFT-LCD driver in accordance with a preferred embodiment of the present invention will be explained in detail using the example below.

Referring to FIG. 5, the data register 41 sequentially stores received data in the same manner as in the related art, in a state where four row addresses form a sub-field. The data register controller 42 controls the data register 41 such that the data register 41 supplies a first data and a third data (both with a positive polarity) to the source driver IC 33 before the data register 41 provides a second data and a fourth data (both with a negative polarity) to the source driver IC 33. The data register controller 42 controls the gate address controller 43 such that the data from the data register 41 to the source driver IC 33 and the signal provided from the gate driver IC 32 are synchronized.

Then, the gate driver IC 32 receives an output from the gate address controller 43, supplying driving voltages to the gate bus lines in the TFT-LCD panel 31, to sequentially turn on the TFT's for the first data, the TFT's for the third data, the TFT's for the second data, and the TFT's for the fourth data. The source driver IC 33 receives an output from the data register 41, and, at first, converts first digital R, G, B data into analog voltages and supplies them to the source bus lines in the TFT-LCD panel 31. Next, the source driver IC 33 converts third digital R, G, B data into analog voltages and supplies them to the source bus lines in the TFT-LCD panel 31. Then, the source driver IC 33 sequentially converts second digital R, G, B data and fourth digital R, G, B data into analog voltages, sequentially supplies them to the source bus lines in the TFT-LCD panel 31, and stores them in the capacitors in the liquid crystal cell array in the TFT-LCD panel 31 by passing them through the TFT's that are turned on by the gate driver IC 32.

In this approach, total power consumption of the source driver IC 33 of the present invention is approximately half the power consumption of the related art source driver, since polarities are changed every time in the related art when four row addresses form a single sub-field, while polarities are changed only half as often in the TFT-LCD driver in accordance with the preferred embodiment of the present invention. Therefore, when eight row addresses form a sub-field, power consumption of the source driver IC 33 of the TFT-LCD driver in accordance with the preferred embodiment of the present invention is reduced to approximately ¼ compared to the power consumption of the related art source driver IC.

Because the TFT-LCD driver of the present invention addresses rows such that the same polarities are repeated at least twice for analog data supplied from the source driver IC to the TFT-LCD panel, with reduced number of alternations from (+) to (−) (and vice versa) per frame compared to the related art, power consumption of the TFT-LCD panel and the source driver IC can be reduced because the number of times required for charging the capacitors in column data lines is reduced.

It will be apparent to those skilled in the art that various modifications and variations can be made in the TFT-LCD driver of the present invention without departing from the spirit or scope of the invention. Thus, it is intended that the present invention cover the modifications and variations of this invention provided they come within the scope of the appended claims and their equivalents.

What is claimed is:

1. A TFT-LCD driver comprising:

a TFT-LCD panel having a plurality of gate bus lines, a plurality of source bus lines, a plurality of TFT's, and a plurality of liquid crystal cells corresponding to the plurality of TFT's;

a gate driver integrated circuit for supplying driving voltages to the gate bus lines to turn the TFT's on and off;

a source driver integrated circuit for initially supplying analog voltages having a polarity and sequentially supplying analog voltages having an opposite polarity to the source bus lines so as to input the analog voltages to the plurality of liquid crystal cells through the turned-on TFT's;

a controller for providing control signals to the gate driver integrated circuit and the source driver integrated circuit; and a data register for temporarily storing external data and grouping the external data into a plurality of sub-fields, wherein the source driver integrated circuit drives the TFT-LCD panel using one of a dot inversion method and a pixel inversion method.

2. The device as claimed in claim 1, wherein the controller further includes:

a data register controller for controlling a sequence of the external data supplied from the data register to the source driver integrated circuit; and a gate address controller for synchronizing the external data supplied to the source driver integrated circuit and for receiving the control signals from the data register controller.

3. A liquid crystal display comprising:

an upper plate;

a lower plate facing the upper plate;

a plurality of gate bus lines and a plurality of source bus lines on the lower plate;

thin film transistors formed at intersections of the gate bus lines and the source bus lines;

a liquid crystal cell capacitor array formed at locations corresponding to the thin film transistors between the upper plate and the lower plate;

a gate driver circuit for turning the thin film transistors on and off;

a source driver circuit for initially supplying analog voltages having a polarity and sequentially supplying analog voltages having an opposite polarity to the liquid crystal cell capacitor array in a row, wherein the analog voltages are stored in the liquid crystal cell capacitor array through the thin film transistors;

a controller for providing control signals to the gate driver circuit and the source driver circuit; and a data register for temporarily storing external data and grouping the external data into a plurality of sub-fields, wherein the source driver circuit drives the liquid crystal display using one of a dot inversion method and a pixel inversion method.

4. The device as claimed in claim 3, wherein the controller further includes:

a data register controller for controlling a sequence of the external data supplied from the data register to the source driver integrated circuit; and a gate address controller for synchronizing the external data supplied to the source driver integrated circuit and for receiving the control signals from the data register controller.

* * * * *